US010807760B1

(12) United States Patent
Telman

(10) Patent No.: US 10,807,760 B1
(45) Date of Patent: Oct. 20, 2020

(54) SELF-SEALING FOLDABLE CONTAINER

(71) Applicant: Christopher Telman, Wilmington, NC (US)

(72) Inventor: Christopher Telman, Wilmington, NC (US)

( * ) Notice: Subject to any disclaimer, the term of this patent is extended or adjusted under 35 U.S.C. 154(b) by 196 days.

(21) Appl. No.: 15/651,404

(22) Filed: Jul. 17, 2017

Related U.S. Application Data

(63) Continuation-in-part of application No. 15/348,016, filed on Nov. 10, 2016, now abandoned.

(51) Int. Cl.
*B65B 7/20* (2006.01)
*B65B 51/06* (2006.01)
*B65D 5/02* (2006.01)

(52) U.S. Cl.
CPC ..... *B65D 5/0236* (2013.01); *B65B 7/20* (2013.01); *B65B 51/067* (2013.01)

(58) Field of Classification Search
CPC ..... B65D 5/0236; B65D 63/1009; B65D 2255/06; B65D 2313/08; B65D 27/14; G09F 3/0288; G09F 3/10; G09F 3/0292; B42D 15/006; B65B 51/067; B65C 1/02
USPC ..... 229/123.1, 125.39, 132, 136, 921, 102, 229/74; 283/81; 53/419; 206/813; 428/202, 41.8, 42.3; 40/630, 638; 493/382, 961
See application file for complete search history.

(56) References Cited

U.S. PATENT DOCUMENTS

| | | | | | |
|---|---|---|---|---|---|
| 2,052,977 | A * | 9/1936 | Hofmann | B65D 5/0227 | 229/123.1 |
| 2,063,999 | A * | 12/1936 | Harrison | C09J 7/21 | 229/123.1 |
| 3,276,664 | A * | 10/1966 | Johnson | B65D 5/0227 | 229/136 |
| 3,302,857 | A * | 2/1967 | Martin | B65D 5/0236 | 229/238 |
| 3,306,521 | A * | 2/1967 | Giacovas | B65D 5/0227 | 229/136 |
| 5,465,900 | A * | 11/1995 | Baratto | B65D 5/4283 | 229/123.1 |
| 5,735,549 | A * | 4/1998 | Konkol | B42D 15/006 | 229/74 |
| 9,428,305 | B2 * | 8/2016 | Cenzano | B65D 27/16 | |
| 9,580,202 | B2 * | 2/2017 | Pettersson | B65D 5/0236 | |
| 2008/0073419 | A1 * | 3/2008 | Kim | B65D 5/0236 | 229/125.37 |

* cited by examiner

*Primary Examiner* — Christopher R Demeree
(74) *Attorney, Agent, or Firm* — Russell D. Nugent; The Humphries Law Firm, P.C.

(57) ABSTRACT

A foldable container and method of using the same that includes one or more strips of adhesive material with one end fixed to the container's exterior surface and the other end inserted through slits in the flaps of the container such that the free ends of the strips of adhesive material are held in place on the container.

A foldable container and method of using the same that features a release liner attached to the side of the foldable container such that strips of adhesive material can be peeled off of a surface of the container and applied to and used to seal the top and bottom surfaces of the container.

3 Claims, 10 Drawing Sheets

SELF-SEALING FOLDABLE CONTAINER

CROSS-REFERENCE TO RELATED APPLICATIONS

This Application claims the benefit of priority and is a Continuation-in-Part of U.S. patent application Ser. No. 15/348,016 filed on Nov. 10, 2016. The content of U.S. patent application Ser. No. 15/348,016 filed on Nov. 10, 2016 is incorporated by reference in its entirety.

BACKGROUND OF THE INVENTION

(a) Field of the Invention

This disclosure concerns the technical field of packaging. More particularly, the application discloses a novel foldable container, such as a cardboard box, that comes with the means to seal the container without the use of a separate supply of tape or other adhesive.

(b) Background Art

Nothing stirs dread in the American heart as much as having to pack and/or move one's personal possessions to another location. Individuals and businesses across the globe use a variety of foldable containers to temporarily or permanently store tangible property, but arguably the most common foldable container is the cardboard box. The typical cardboard box is sold as a flattened structure that can be opened and folded into a three dimensional box with a top and bottom surface capable of being opened and closed and/or sealed closed.

While the structure of a foldable container, such as, but not limited to a cardboard box, is not something that needs to be detailed in this application, a brief description of such a foldable container will simplify the forthcoming disclosure. The typical cardboard box has four side surfaces each with sets of flaps that may be the same or different sizes. Generally, two of the sides will feature two smaller or "minor" flaps, one located at a first end or "top" of a side surface and another minor flap at a second end or "bottom" of the same side surface. In addition, there are two larger flaps, i.e. major flaps that are located at a first end or "top" of a side surface that does not feature minor flaps and another major flap located at a second end or "bottom" of that same side surface. As stated above, with some containers, the major and minor flaps will be the same sizes. The side surfaces featuring minor flaps are directly opposed to each other and are substantially parallel to each other when the container is folded into an assembled state. In this context, the term directly opposed side surfaces refers to side surfaces that are on opposite sides of the container when the container is opened and folded into a three dimensional box. Substantially parallel in this context means that the structures being referred to are positioned in planes that are within two inches of being equidistant from each other at all points. In addition, the side surfaces featuring major flaps are directly opposed to each other and are substantially parallel to each other when the container is folded into an assembled state. The side surfaces featuring major flaps are also substantially perpendicular to the side surfaces featuring minor flaps. In this context, substantially perpendicular means that the structures referred to are positioned in planes that are either at right angles to each other or are at an angle of between 85.0 and 95.0 degrees to each other. As a result, when the flattened box structure is opened, the major and minor flaps can be folded over each other to form a top surface and/or a bottom surface of the box. Generally, the two minor flaps are folded down such that they are substantially perpendicular to the side surfaces of the box. Next the major flaps are folded down over the minor flaps producing a closed surface at either end of the container.

Sealing such a foldable container is generally accomplished by attaching an adhesive substance such as tape to one or more of the flaps after folding the flaps over each other to form a top or bottom surface of the container. Either an adhesive glue is attached to one or more of the surfaces of the flaps such that the adhesive will attach one flap to another when they are in contact; or more commonly, a strip of adhesive material, i.e. tape, is applied to the outside of the box after the flaps are folded down over one another. Generally, the adhesive material is placed over the free edges of the major flaps after they are folded over the minor flaps.

Sealing the box itself presents a handful of difficulties for which there is not an adequate solution in the prior art. More specifically, boxes and adhesive tape must be purchased separately and in quantities that never match. Anyone that has ever packed a significant amount of their property into cardboard boxes or similar containers has encountered the same situation, namely, that one either runs out of tape before all of the boxes have been sealed or one is left with a lot of leftover packing tape that has no other practical purpose other than sealing boxes. Moreover, applying the tape to the boxes in and of itself can present a handful of difficulties including but not limited to trying to remove the edge of the tape from the roll without tearing the tape unevenly, applying the tape to the box evenly without the tape adhering to itself, or unevenly tearing the tape off the roll of tape before applying the tape to the box. Last, but certainly not least, there is the difficulty inherent in storing packing materials separately, e.g., one may have boxes, but no available tape or vice versa.

The present disclosure describes a foldable container that will provide a consumer with an easy and affordable way to seal a foldable container without possessing a separate supply of adhesive. Inherent in this disclosure is not only a device that stores the proper amount of adhesive material with itself, but a method for doing the same and for using such a foldable container.

BRIEF SUMMARY OF THE INVENTION

While the preferred embodiments of the container are configured similar to the foldable container as described above, the container can be all shapes and sizes, whether foldable or not. Moreover, these embodiments can be used with a container that does not feature flaps. A previously disclosed embodiment of the container includes one or more strips of adhesive material attached to opposing sides of a foldable container such that when the minor and major flaps are folded down over each other, the adhesive material is positioned to overlap one or both of the top or free edges of the flaps visible from the outside of the container to seal the foldable container. These embodiments include strips of adhesive material located on one or more side surfaces of the container featuring a flap, thus allowing the user to seal both the top and the bottom surfaces of the container. Each strip of adhesive material has two ends. The first end of each of the strips of adhesive material is attached to one of the side surfaces of the foldable container prior to unfolding the box, i.e. when it is in a knock-down state. The second end of the strip of adhesive material features a release liner attached to the sticky surface of the strip of adhesive material such that the strip of adhesive material does not inadvertently adhere to the container while the container is being stored or transported. Certain embodiments of the present invention include, but are not limited to, a second adhesive located on one or more flaps, preferably the minor flap(s) that are adjacent to and connected to the side surface to which the strip of adhesive material is attached. This configuration allows the second end of the strip of adhesive material featuring the release liner to be removably or releasably secured to the surface of the foldable container via the second adhesive. In some embodiments, the second adhesive is a pressure sensitive glue or tape, e.g., a pressure sensitive adhesive dot. However, other adhesives including structural adhesives like glue could be used in place of a pressure sensitive adhesive in which case it may be preferable to cover the second adhesive with a release liner.

In another embodiment of the foldable container includes a release liner fixed solely to a side surface of the container or to a flap of the same container. Whether a side surface or a flap, the same surface features one or more strips of adhesive material attached to the release liner. Other variations on this embodiment include more than one side surface featuring a release liner and one or more strips of adhesive material attached and/or other surfaces of the box, i.e. the flaps featuring a release liner with one or more strips of adhesive material attached. The difference between this embodiment and those previously described is that instead of a strip of adhesive material with a first end attached to the foldable container and a second end featuring a release liner attached elsewhere, this embodiment includes a release liner fixed to an outer surface of the container—the major or minor flaps for example—with strips of adhesive material fixed to the release liner not the container itself. In fact, the contemplated best mode of this invention is a foldable container with a release liner sized to engage with two strips of adhesive material attached to the flaps at either end of a single side surface. Such a preferred embodiment features four strips of adhesive material, two attached to each of two different flaps—preferably the major flaps.

To seal this particular embodiment of the container, a user generally assembles or unfolds the foldable container starting from its knock-down state. Next the user folds each of the minor flaps at one end of the foldable container such that they are substantially perpendicular to the side surfaces. Then the user folds the major flaps attached to the same end of the container such that they lay on top of the minor flaps. At that point, the container is ready to be sealed, i.e. a top or bottom surface has been created with the folded flaps. The process for sealing the top and bottom of the container are identical. The user removes a strip of adhesive material from the release liner(s) featured on the exterior of the foldable container and places that strip of adhesive material on the foldable container over the free edges of the flaps visible from the outside of the container and a portion of a first side surface of the foldable container.

A second strip of adhesive material is then removed from the same release liner featured on the exterior surface of the foldable container and placed on the foldable container over the free edges of the same flaps and a portion of a second or opposing side surface of the foldable container. Preferred variations of this embodiment include an overlapping portion of adhesive material. More specifically, the strips of adhesive material are placed such that one end of each strip of adhesive material overlaps with an end of the other strip of adhesive material forming an overlapping portion of adhesive material on the top or bottom surface of the container. This process is repeated with the other side of the foldable container to seal the opposing surface, i.e. the unsealed top or bottom, of the container using the other strips of adhesive material attached to a different portion of the exterior of the container. In a final embodiment of the container, one or more of the side surfaces or flaps of the foldable container feature slits that are large enough to allow the strip of adhesive material to pass through. The slits traverse the container from the interior of the foldable container to the exterior of the foldable container. As with other embodiments, the strip of adhesive material has a first end and a second end. The second end of the strip of adhesive material features a release liner and is inserted through one of the slits featured on the container such that the strip of adhesive material traverses the outer surface of the container from the exterior to the interior of the container. The first end of the strip of adhesive material is attached to a side surface of the container as in other embodiments. As a result of the strip of adhesive material being attached to the container at one end and inserted through a slit at the other end, the container holds the strip of adhesive material in place before it is in use.

In addition, some embodiments will feature a second adhesive located on a surface on the interior of the container. Such an adhesive will allow the manufacturer to attach each strip of adhesive material to a surface on the interior of the container after the second end of each strip of adhesive material is inserted through a slit.

While the slits can be located in a number of different positions including the side surfaces and the major flaps of the container, it is preferable to feature them on the minor flaps. This configuration puts the strip(s) of adhesive material in position to overlap one or both of the top or free edges of the flaps visible from the outside of the container to seal the foldable container.

The preferred version of this particular embodiment is a container that features at least four slits—one on each minor flap attached to either end of a side surface. As can be appreciated by a skilled artisan, it would be preferable to include the slits and the strips of adhesive material on at least two opposing sides of the container, but the container could feature slits and strips of adhesive material on as few as one side or as many as four sides of the container. In preferred embodiments, the container features four strips of adhesive material each attached at a first end to a side surface of the container with the second end featuring a release liner inserted through a slit on the flaps that are directly attached to the top and bottom of each side surface.

During use, this configuration allows the user to unfold the flattened container, remove each of the second ends of the strips of adhesive material from the slits featured on minor flaps at either end of the opposing side surfaces, fold the minor flaps down, and fold the major flaps over the minor flaps, at which point, the user will remove the release liners from one strip of adhesive material and lay that strip across the flaps that now comprise the top surface of the container. The user then repeats this action with the strips of adhesive material that have been inserted through slits in each of the minor flaps producing a sealed foldable container. Moreover, to the extent that the strips of adhesive material overlap when they are laid over the top and/or bottom of the container, the resulting overlapping portion makes it easier to remove the strips of adhesive material.

Each of these containers represents a method of storing adhesive material with the foldable container to which it will eventually be applied. Moreover, each of these containers represents a method of storing the correct amount of adhesive with a foldable container to which it will eventually be applied. Moreover, each of these containers represents a separate method of sealing a foldable container configured to store adhesive material. As discussed in detail below, the inventor has created a novel storage container that eliminates a number of the difficulties inherent in using a separate adhesive material to seal with container.

DETAILED DESCRIPTION OF THE INVENTION

Figure 1:
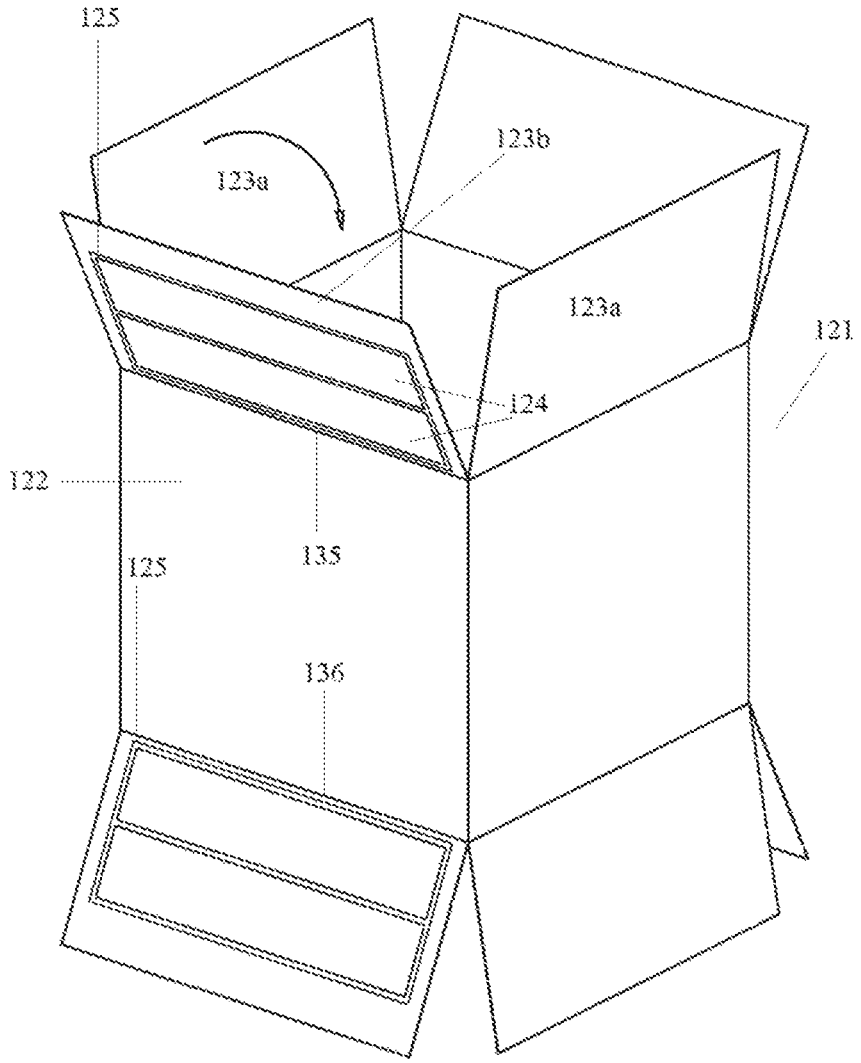
FIG. 1 is a top perspective view of a first disclosed embodiment of the foldable container prior to being sealed.

FIG. 1 demonstrates the first improved version of the inventive foldable container 121 that includes two large mid-ply release liners 125 attached to two flaps 123 of the container 121. In this embodiment, the strips of adhesive material 124 are removed from the mid-ply release liner 125 and then placed over the folded flaps 123 that comprise the top and bottom of the sealed container 121. As a result, their initial placement does not dictate their final placement in any manner. A skilled artisan will realize that the mid-ply release liner 125 can be attached to any of the side surfaces 122 or the flaps 123 of the foldable container 121. Each foldable container 121 features a release liner 125 large enough to accommodate at least one strip of adhesive material 124. The strip(s) of adhesive material 124 can vary in size depending on the number of strips and how long they need to be to properly seal the foldable container 121. Preferred embodiments of this foldable container 121 feature strips of adhesive material 124 that are five (5), six (6), seven (7), nine (9), ten and a half (10.5), twelve (12), thirteen (13) and fifteen (15) inches long. In addition, preferred embodiments of this foldable container 121 feature strips of adhesive material 124 that are two (2), three (3) and three and a half (3.5) inches wide.

In this version of the foldable container 121, a single side surface 122 or flap 123 can feature a mid-ply release liner 125 with two or more strips of adhesive material 124; each strip of adhesive material 124 ideally being separated from the adjacent strip(s) of adhesive material by approximately one-eighth (⅛) of an inch, i.e. 0.125 inches. Other variations on this embodiment include more than one side surface 122 or flap 123 featuring a release liner 125 with one or more strips of adhesive material 124 attached. Further, any surface of the container 121, i.e. the minor flaps 123*a* or the major flaps 123*b* can feature a release liner 125 with one or more strips of adhesive material 124 attached.

FIG. 1 also shows the initial step in sealing a foldable container with this embodiment of the foldable container 121. FIG. 1 shows a perspective view of a foldable container 121 featuring two minor flaps 123*a*, two major flaps 123*b* and four side surfaces 122. In addition, the foldable container 121 in FIG. 1 features release liners 125 on each of two major flaps 123*b* located at the first end 135 and second end 136 of the side surface 122 closest to the viewer. First, the minor flaps 123*a* are folded down such that they are substantially perpendicular to the side surfaces 122 of the foldable container 121. The user then folds the major flaps 123*b* down over the minor flaps 123*a* such that they are substantially perpendicular to the side surfaces 122 of the foldable container 121. At this point, the user has a foldable container with a top 126 or bottom surface 127 ready to be sealed. This same process is used to close and form the opposing top or bottom surface of the foldable container.

FIGS. 2 through 6 show the same foldable container 121 with the top surface 126 and bottom surface (not shown) formed from the folded flaps 123. The user peels a strip of adhesive material 124 off of the mid-ply release liner 125 located on flap 123 that is still exposed to the user. Note, this is one of the advantages to attaching the release liners 125 to the major flaps 123*b* as they are typically still exposed to the user after the flaps 123 have been folded over one another. After removing the strip of adhesive material 124 from one of the major flaps 123*b* of the foldable container 121, the strip of adhesive material 124 is placed or laid over the top surface 126 of the foldable container 121. As discussed previously, there are advantages to placing the strip(s) of adhesive material 124 over the free edges 131 of the major flaps 123*b*, but the strips of adhesive material 124 can be placed in virtually any orientation over the surface(s) of the foldable container 121 that the user desires to seal.

Next the user the user removes a second strip of adhesive material 124 from the release liner 125 on a flap 123. After removing the strip of adhesive material 124 from the flap 123 of the foldable container 121, the strip of adhesive material 124 is placed or laid over the top surface 126 of the foldable container 121 formed from the folded flaps 123. As with previously described embodiments, each of the strips of adhesive material 124 can be placed such that they meet and form an overlapping portion 133 of adhesive material. This overlapping portion 133 oftentimes makes it easier to remove the strips of adhesive material 124 as it is easier to peel the adhesive material away from the back surface of the strip of adhesive material 124 than from the foldable container 121, especially when said container 121 is made of cardboard or other paper based material.

The user then repeats these steps using the strips of adhesive material 124 attached to the release liner 125 located on the other flap 123 featuring the release liner 125 and strips of adhesive material 124 to seal the bottom surface 127 of the container 121.

Figure 7:
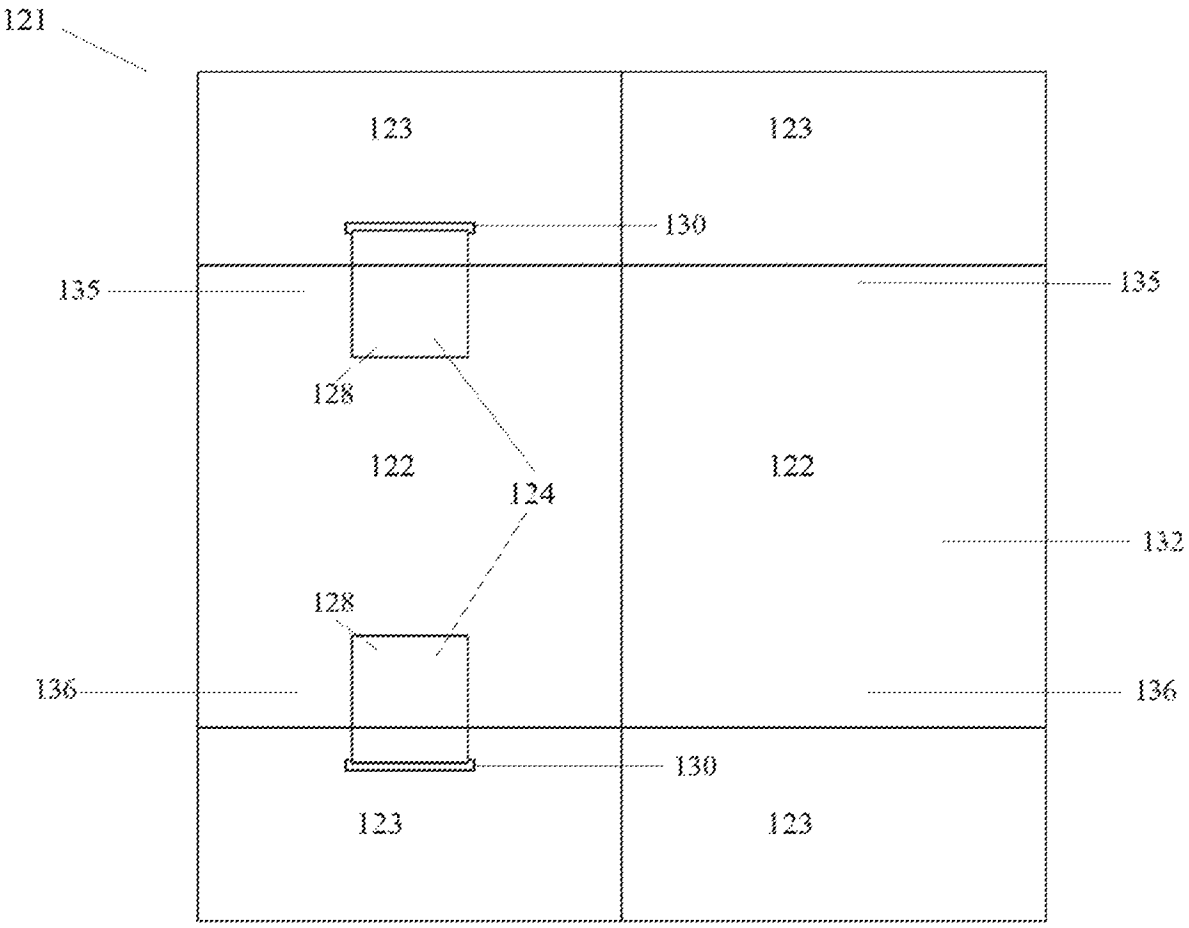
FIG. 7 is a top plan view of the foldable container in "knock-down" position featuring a second embodiment of the container.

Referring now to the second embodiment of the container disclosed in this application, FIG. 7 shows a top plan view of a foldable container 121 in a "knock-down" state or position, i.e. the container 121 is flattened for transport. The container 121 in FIG. 1 has four side surfaces 122 only two of which are viewable from the current perspective. The other side surfaces 122 of the container 121 that are not viewable from this perspective feature the same elements and structures as the side surfaces 122 that are visible in FIG. 7. However, it is possible for the opposing surfaces of the container 121 to feature any or all of the elements and structures described in the various embodiments above and below, i.e. they are not required to be identical to each other, but in preferred embodiments the opposing side surfaces 122 and their respective flaps 123 are identical to each other.

In this embodiment, each of the side surfaces 122 features a flap 123 at either end of each side surface 122. More specifically, each side surface 122 has a flap 123 located at a first end 135 of the side surface 122 and a second flap 123 located at a second end 136 of the side surface 122. FIG. 1 also shows slits 130 in the container 121, each of which traverses the container 121 from the interior (not shown) of the container 121 to the exterior 132 of the container 121. While other embodiments may feature the slits 130 in a different location, such as the side surfaces 122 of the container 121, FIG. 1 shows slits 130 in the flaps 123. More specifically, the foldable container 121 in FIG. 7 features two opposing side surfaces 122, each of which feature two flaps 123, and each of those flaps 123 features a slit 130. Further, FIG. 1 shows two strips of adhesive material 124 attached to the side surface 122 of the container 121 below the flaps 123 that feature slits 130. Each strip of adhesive material 124 has a first end 128 and a second end (not shown). The first end 128 is attached to the side surface 122 of the container 121. The second end 129, featuring a release liner 125, is inserted through the slit 130 in the adjacent flap 123.

Figure 2:
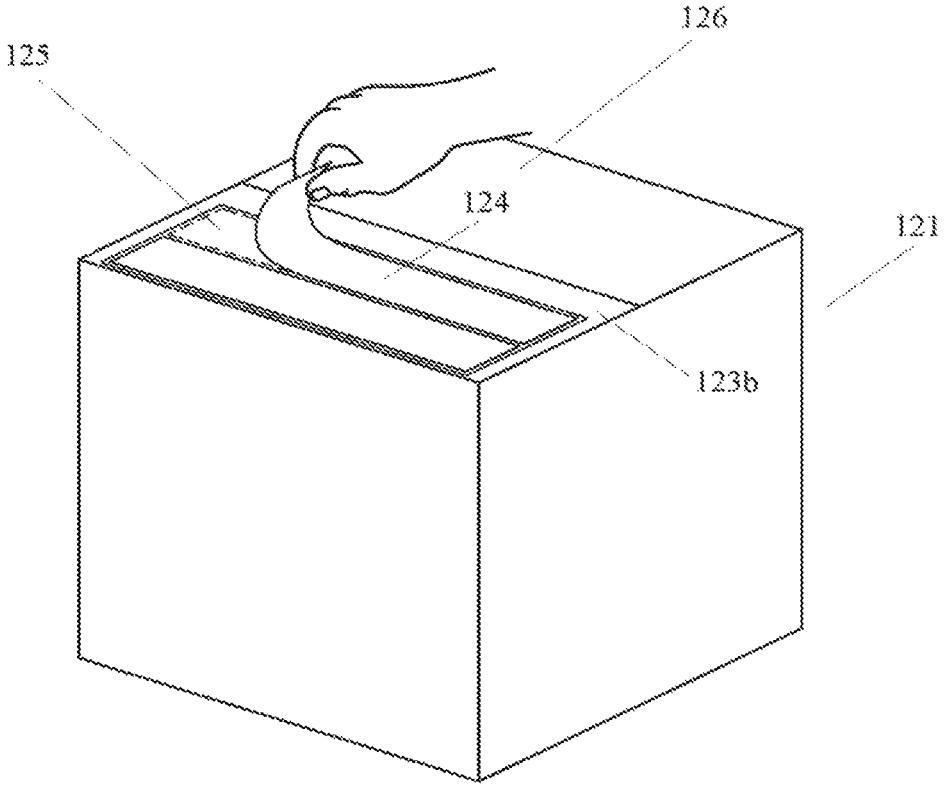
FIG. 2 is a top perspective view of the same container in closed, but unsealed state.
Figure 3:
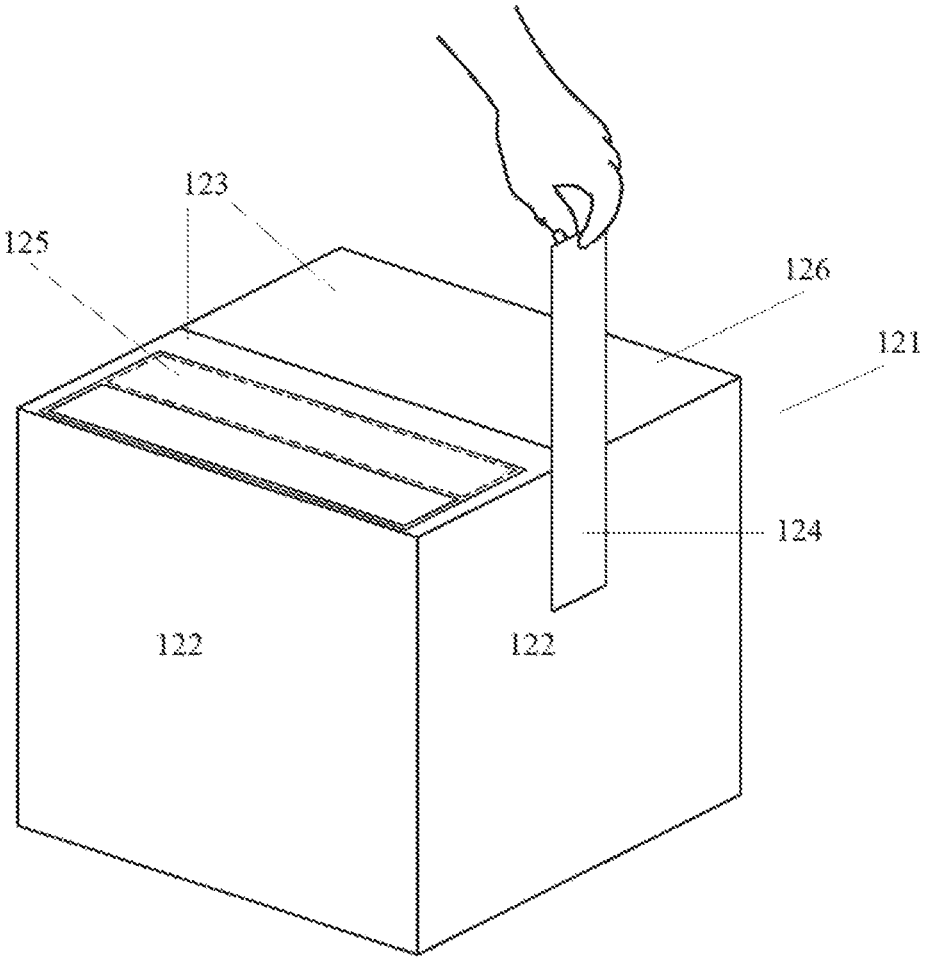
FIG. 3 is a top perspective view of the same container with a first strip of adhesive material removed.
Figure 4:
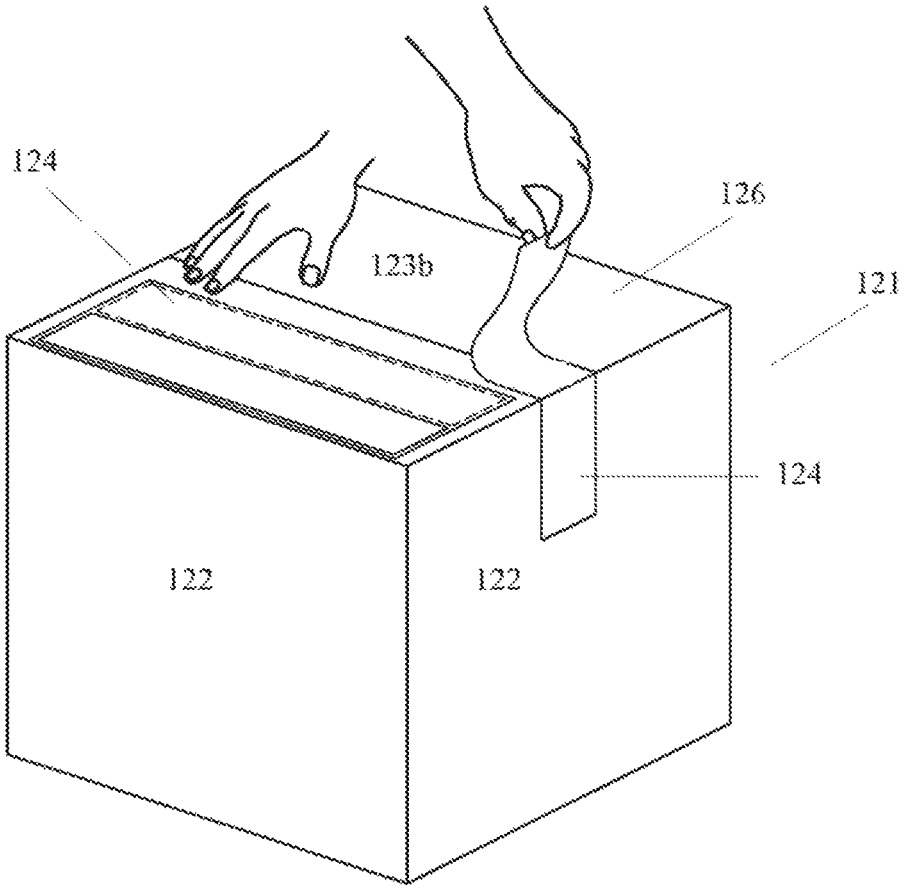
FIG. 4 is a top perspective view of the same container being sealed with a first strip of adhesive material.
Figure 5:
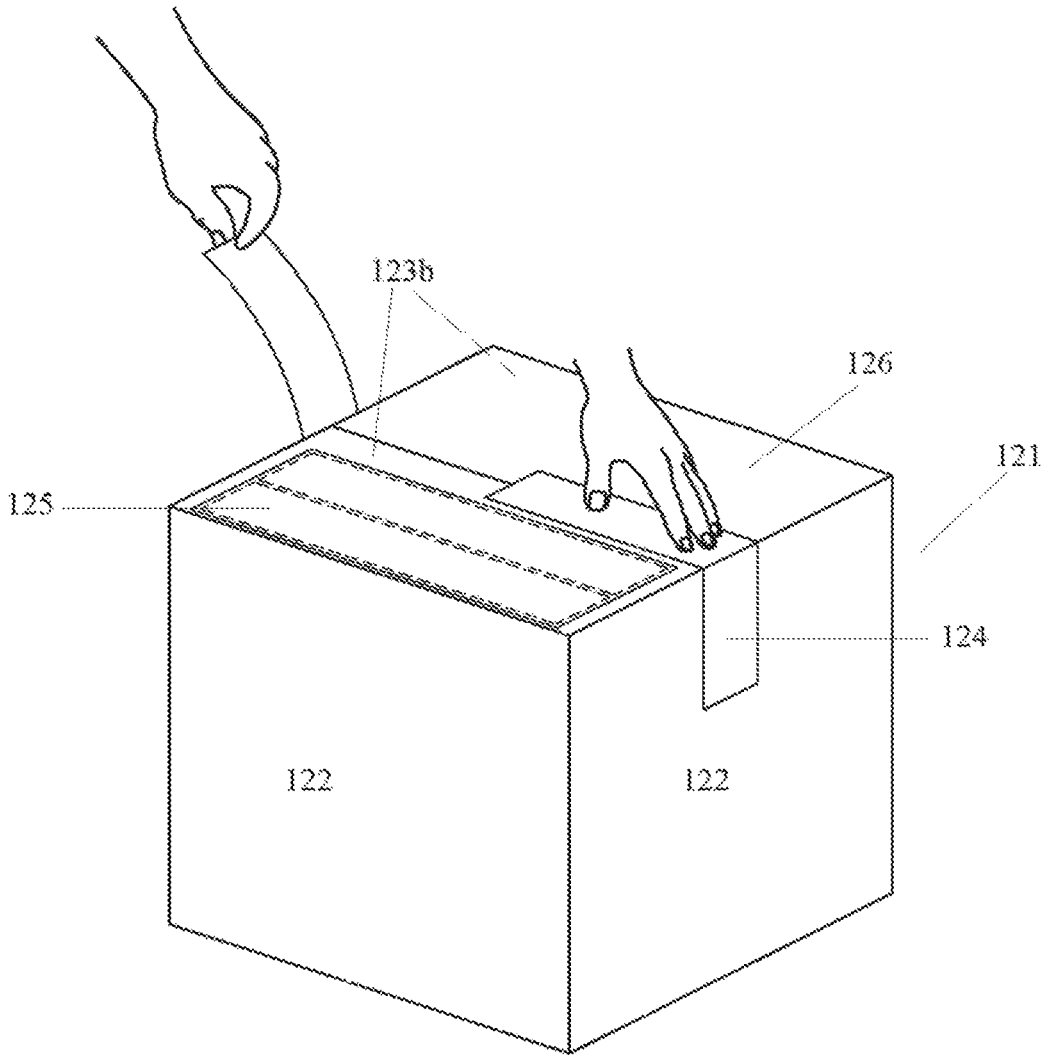
FIG. 5 is a top perspective view of the same container being sealed with a second strip of adhesive material.
Figure 6:
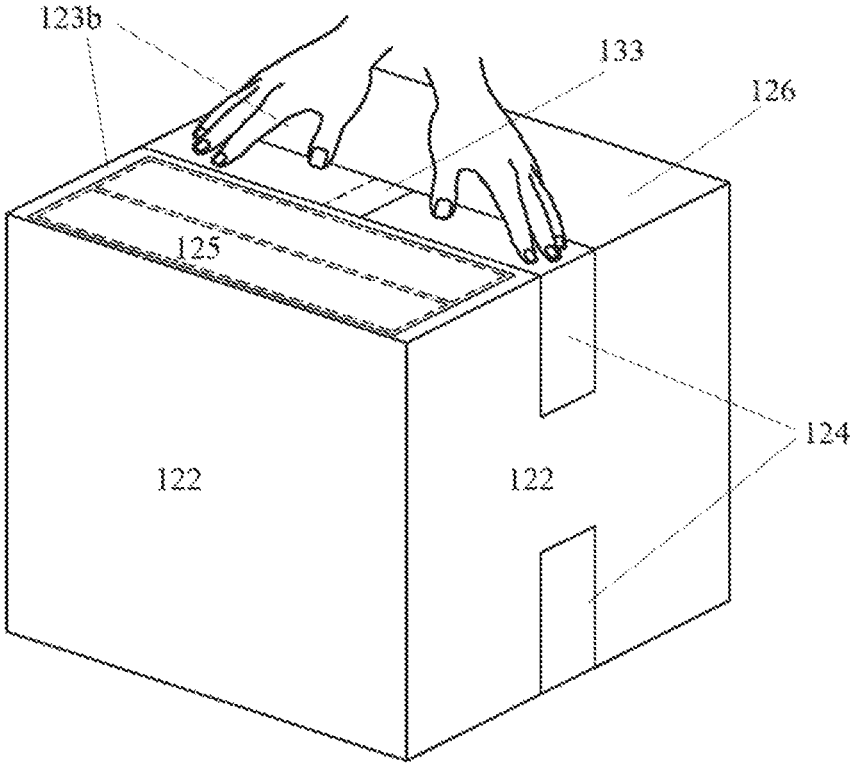
FIG. 6 is a top perspective view of the same container sealed with a second strip of adhesive material.
Figure 8:
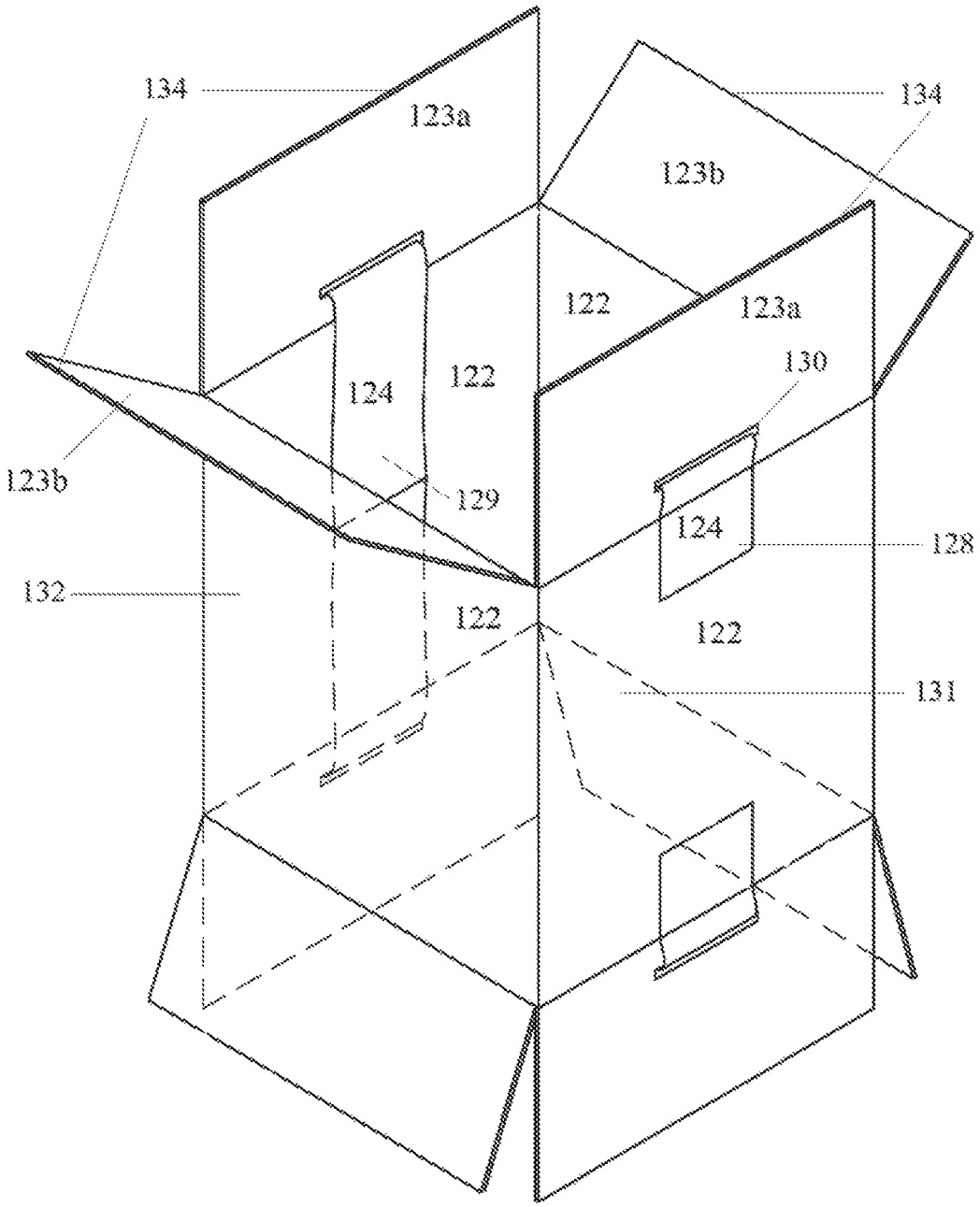
FIG. 8 is a perspective view of the second embodiment of the foldable container after it is unfolded, but not sealed.

Referring now to FIG. 8, the foldable container 121 is shown in an unfolded state prior to the top or bottom being sealed. FIG. 2 shows two strips of adhesive material 124 inserted through the slits 128 in each of two side surfaces 122. Each strip of adhesive material 124 has a first end 128 and a second end 129. The first end 128 of each strip of adhesive material 124 is attached to the exterior 132 of the container 121—adjacent to a flap 123, and the second end 129 of each strip of adhesive material 124 has been inserted through a slit 130 in the flaps 123 of the container 121. The second ends 129 of the strips of adhesive material 124 are inserted into a slit 130 located on the flaps 123 such that they traverse the foldable container 121 from its exterior 132 to its interior 131.

While each strip of adhesive material 124 can be attached to any of the four side surfaces 122 of the foldable container 121, it is preferable to attach the strips of adhesive material 124 to the side surfaces 122 that feature minor flaps 123*a*. As shown below, this configuration allows the user to place the strips of adhesive material 124 over one or both of the top or free edges 134 of the flaps 123 visible from the outside, i.e. the major flaps 123*b*, of the container 121 to seal the foldable container 121. The foldable container 121 is thus prepared for use.

Figure 9:
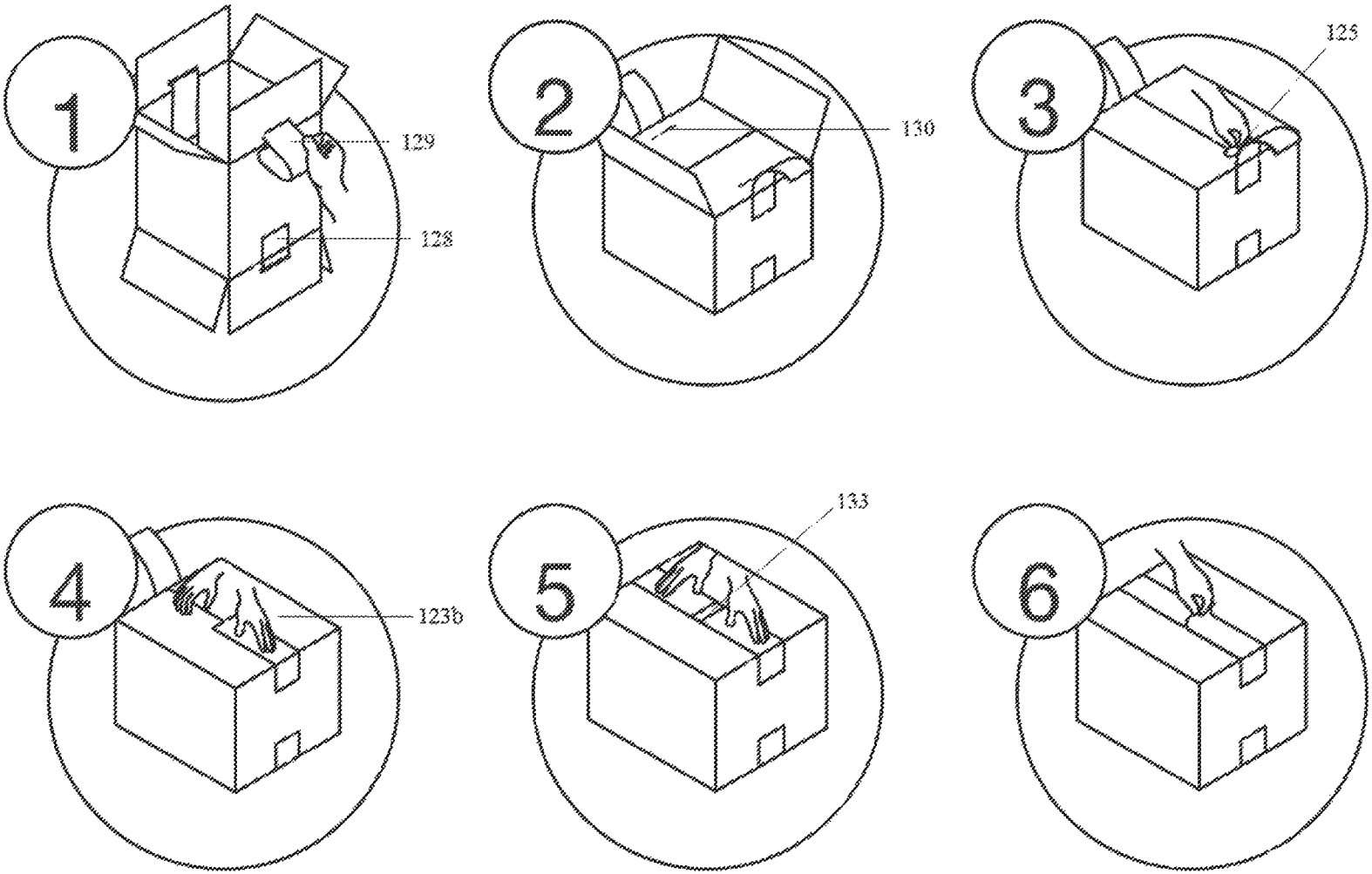
FIG. 9 is a flow chart showing the method of sealing a foldable container featuring the second embodiment of the container.

FIG. 9 is a flow chart showing each of the steps necessary to seal the foldable container 121. In Step 1, the second end 129 of each of the strips of adhesive material 124 is pulled out of the slits 130 in each of the minor flaps 123*a*. In step 2, the minor flaps 123*a* are folded down such that they are substantially perpendicular to the side surfaces 122 of the foldable container 121. The first end 128 of the strips of adhesive material 124 remain attached to the side surfaces 122.

In Step 3, the user then folds the major flaps 123*b* down over the minor flaps 123*a* such that they are substantially perpendicular to the side surfaces 122 of the foldable container 121. Next the user removes the release liner 125 that is present on the second end 129 of the strip of adhesive material 124. In Step 4 the user places the second end 129 of the strip of adhesive material 124 from which the release liner 125 has been removed over the top surface 126 of the container 121. Similarly, in Step 5, the release liner 125 is removed from the second end 129 of a strip of adhesive material 124 and the second end 129 is placed over the top surface 126 of the container 121. This figure demonstrates why it is preferable to place the strips of adhesive material 124 on the side surfaces 122 that feature the minor flaps 123*a*. Doing so allows the user to place the strip of adhesive material 124 over the free edges 134 of the major flaps 123*b* thus sealing the top of the foldable container 121.

When the second ends 129 of each of the strips of adhesive material 124 are in place the second ends 129 overlap forming an overlapping portion 133 of adhesive material. The overlapping portion 133 facilitates opening the container 121 after it is sealed as discussed previously. A skilled artisan will immediately appreciate that while desirable, the overlapping portion 133 of adhesive material is not required for the container 121 to be sealed. This same process is also repeated with the second ends 129 of the strips of adhesive material 124 on the opposite end, i.e. bottom surface (not shown) of the container 121 such that both the top and bottom of the container 121 are sealed.

The final illustration in FIG. 9 demonstrates the initial step in opening or unsealing of the foldable container 121. More specifically, the user peels back the second end 129 of one of the strips of adhesive material 124 starting at the overlapping portion 133 pulling that strip of adhesive material 124 away from the major flaps 123*b*. Next the same action is performed with the second end 129 of the strip of adhesive material 124 located attached to the opposing side surface 122 thus freeing the free edges 134 of the major flaps 123*b*.

Figure 10:
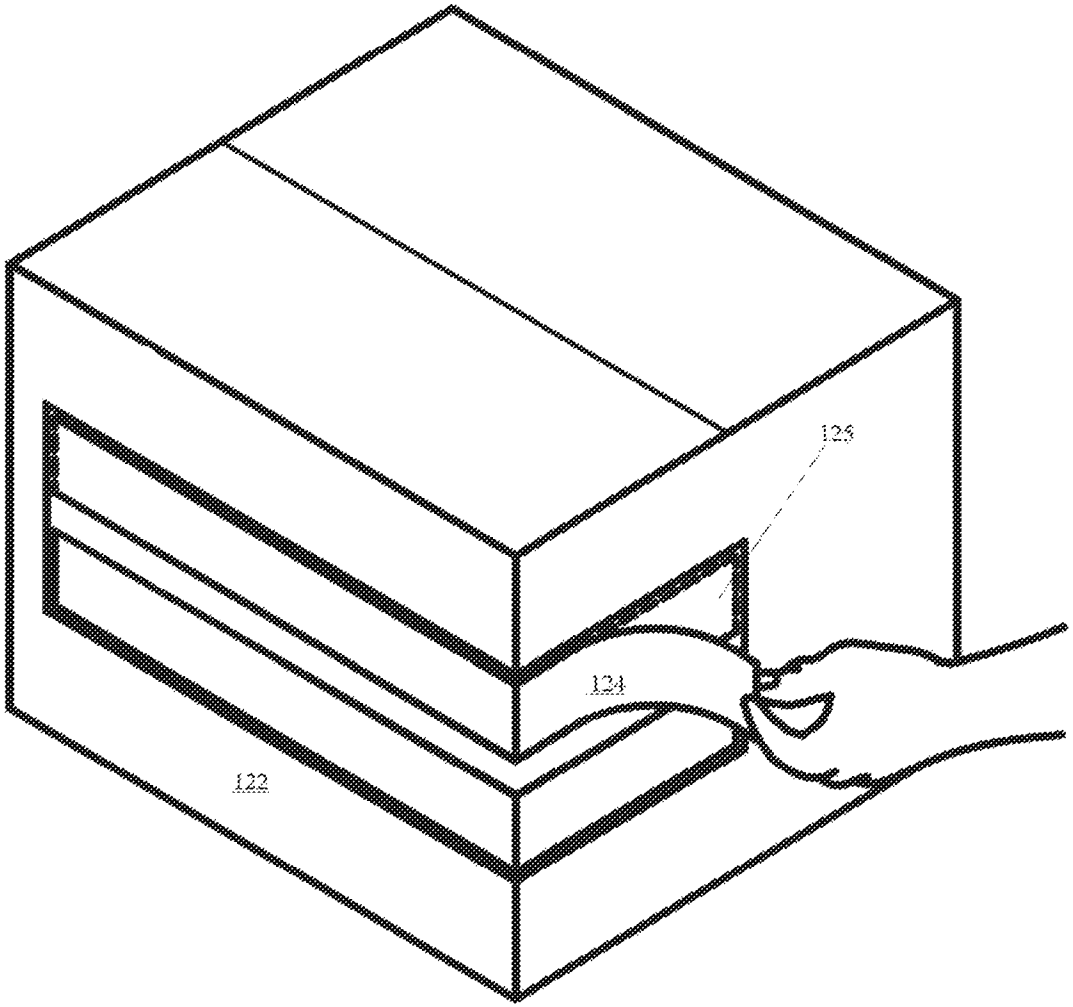
FIG. 10 is a perspective view of a third embodiment of the foldable container featuring a release liner attached to a side surface of the container.

FIG. 10 shows an alternate embodiment of the presently disclosed container 121 showing the release liner 125 attached to a side surface 122 of the container.

While the above description details the preferred embodiments of the container, there are other embodiments that are anticipated by the Inventor. More specifically, the container can be any foldable container and need not be a cardboard box, nor does the container need to be a four sided structure. In addition, just as the container need not have four side surfaces, it need not incorporate four to eight flaps. The container can have only one flap or even a separate lid. In addition, the strips of adhesive material do not have to be fixed to the side surfaces of the box in the locations shown in the figures. They could be placed anywhere on the side of the container regardless of whether they are positioned to overlap the free edges of the major flaps. In addition, each strip of adhesive material is generally made of packing tape, i.e., tape that is made of a polypropylene or polyester backing, but can be any number of adhesive materials including other types of tape like duct, electrical, acetate or masking tape.

Furthermore, it is worth noting, sealing the top and bottom surfaces of the foldable container is accomplished through identical means—that is to say, the top surface of the foldable container and the bottom surface of the same container are sealed in the same manner using the same structures.

The advantages of the present invention include, without limitation, the ability to purchase packing materials in the exact proportions or quantities needed to fulfill the user's purposes. In addition, the container makes storing pacing materials together very simple and convenient. The disclosed container creates a simple to use, single piece container available for packing tangible property. It also makes for a simpler means of opening a sealed foldable container. Moreover, the embodiments disclosed in this application represent a significantly more efficient way of transporting foldable containers with adhesive materials attached to them, without the strips of adhesive material becoming snagged or hung up or accidentally removed from the container during transport.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

The present invention may address one or more of the problems and deficiencies of the prior art discussed above. However, it is contemplated that the invention may prove useful in addressing other problems and deficiencies in a number of technical areas. Therefore the claimed invention should not necessarily be construed as limited to addressing any of the particular problems or deficiencies discussed herein.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A method of storing adhesive material with packing material using a foldable container having an interior, an exterior, a plurality of side surfaces and a plurality of flaps attached to said side surfaces comprising:

providing the container with at least one release liner featured on a surface of the foldable container; and releasably attaching the entire length of at least two strips of adhesive material to the at least one release liner such that the at least two strips of different lengths of adhesive material can be placed anywhere on the container.

2. A method of storing adhesive material with packing material using a foldable container having an interior, an exterior, a plurality of side surfaces and a plurality of flaps attached to said side surfaces comprising:

providing the container with at least one release liner on a side surface of the foldable container, releasably attaching the entire length of at least two strips of adhesive material to the at least one release liner such that the at least two strips of adhesive material can be placed anywhere on the container.

3. A method of storing adhesive material with packing material using a foldable container having an interior, an exterior, a plurality of side surfaces and a plurality of flaps attached to said side surfaces comprising:

providing the container with at least one release liner on a flap of the foldable container; and releasably attaching the entire length of at least two strips of adhesive material to the at least one release liner such that the at least two strips of adhesive material can be placed anywhere on the container.

* * * * *